US010148049B2

(12) United States Patent
Yi

(10) Patent No.: US 10,148,049 B2
(45) Date of Patent: Dec. 4, 2018

(54) RF CONNECTOR SYSTEM HAVING CONNECTOR CAVITIES WITH SIDE OPENINGS

(71) Applicant: TYCO ELECTRONICS CORPORATION, Berwyn, PA (US)

(72) Inventor: Chong Hun Yi, Mechanicsburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/265,312

(22) Filed: Sep. 14, 2016

(65) Prior Publication Data

US 2018/0076583 A1 Mar. 15, 2018

(51) Int. Cl.

| | |
|---|---|
| ***H01R 24/38*** | (2011.01) |
| ***H01R 25/00*** | (2006.01) |
| ***H01R 12/71*** | (2011.01) |
| ***H01R 13/422*** | (2006.01) |
| ***H01R 24/40*** | (2011.01) |

(Continued)

(52) U.S. Cl.

CPC ..... *H01R 25/003* (2013.01); *H01R 9/0515* (2013.01); *H01R 12/716* (2013.01); *H01R 13/422* (2013.01); *H01R 13/518* (2013.01); *H01R 24/40* (2013.01); *H01R 25/006* (2013.01); *H01R 9/05* (2013.01); *H01R 9/0506* (2013.01); *H01R 13/426* (2013.01); *H01R 13/514* (2013.01); *H01R 13/659* (2013.01);

(Continued)

(58) Field of Classification Search

CPC ..... H01R 24/38; H01R 9/05; H01R 9/0506; H01R 24/50; H01R 13/426; H01R 13/514; H10R 13/519

USPC ..... 439/578, 579, 580, 63, 708, 709, 540.1, 439/541.5

See application file for complete search history.

(56) References Cited

U.S. PATENT DOCUMENTS 5,405,267 A * 4/1995 Koegel ..... H01R 13/518 439/79

5,906,511 A 5/1999 Bozzer et al.

(Continued)

FOREIGN PATENT DOCUMENTS

| | | | |
|---|---|---|---|
| JP | 2010 092811 A | | 4/2010 |
| JP | 2016 100190 A | | 5/2016 |
| JP | 2016100190 A | * | 5/2016 |

OTHER PUBLICATIONS

International Search Report, Application No. PCT/IB2017/055523, International Filing Date, Sep. 13, 2017.

*Primary Examiner* — Abdullah Riyami
*Assistant Examiner* — Justin Kratt

(57) ABSTRACT

An RF connector system includes receptacle and plug connector assemblies. The receptacle connector assembly includes a receptacle housing configured to be mounted to a circuit board and a mounting end and having connector cavities and side openings open to corresponding connector cavities. RF receptacle connectors are side-loaded into the connector cavities through corresponding side openings. The RF receptacle connectors have solder tails soldered to the circuit board. The plug connector assembly has a plug housing including connector cavities and RF plug connectors received in corresponding connector cavities and mated with a corresponding RF receptacle connectors. The RF plug connectors are terminated to center conductors of coaxial cables.

20 Claims, 4 Drawing Sheets

(51) Int. Cl.

| | |
|---|---|
| ***H01R 13/518*** | (2006.01) |
| *H01R 9/05* | (2006.01) |
| *H01R 13/426* | (2006.01) |
| *H01R 13/514* | (2006.01) |
| *H01R 13/659* | (2011.01) |
| *H01R 24/50* | (2011.01) |
| *H01R 103/00* | (2006.01) |

(52) U.S. Cl.
CPC ..... *H01R 24/38* (2013.01); *H01R 24/50* (2013.01); *H01R 2103/00* (2013.01)

(56) References Cited

U.S. PATENT DOCUMENTS

| | | | | |
|---|---|---|---|---|
| 7,165,974 | B2 * | 1/2007 | Kooiman ..... | H01R 24/52 439/63 |
| 2004/0029406 | A1 | 2/2004 | Loveless | |
| 2009/0029589 | A1 | 1/2009 | Conner et al. | |
| 2010/0062638 | A1 * | 3/2010 | Benham ..... | H01R 23/688 439/578 |

* cited by examiner

RF CONNECTOR SYSTEM HAVING CONNECTOR CAVITIES WITH SIDE OPENINGS

BACKGROUND OF THE INVENTION

The subject matter herein relates generally to radio frequency (RF) connector systems.

Due to their favorable electrical characteristics, coaxial cables and connectors have grown in popularity for interconnecting electronic devices and peripheral systems. A typical application utilizing coaxial cable connectors is an RF application having RF plug connectors designed to work at radio frequencies in the UHF and/or VHF range. RF plug connectors are used with coaxial cables and are designed to maintain the shielding that the coaxial design offers. RF plug connectors are typically designed to minimize the change in transmission line impedance at the connection by utilizing contacts that have a short contact length.

Typically, one or more of the RF plug connectors are mounted to a circuit board of an electronic device at an input/output port of the device and extends through an exterior housing of the device for connection with a coaxial cable connector. In conventional systems, the RF plug connectors may be individually soldered to the circuit board. For example, the RF plug connectors typically include an inner conductor, which is coaxially disposed within an outer conductor with a dielectric material separating the inner and outer conductors, the inner conductor being soldered to the circuit board. The coaxial cable connectors are then mated with corresponding board-mounted RF plug connectors, typically on an individual basis.

A need remains for an RF plug connector system having RF plug connectors that may be assembled to a circuit board in a cost effective and reliable manner and mated with RF cable connectors in a cost effective and reliable manner.

BRIEF DESCRIPTION OF THE INVENTION

In one embodiment, an RF connector system is provided including a receptacle connector assembly and a plug connector assembly coupled to the receptacle connector assembly. The receptacle connector assembly includes a receptacle housing extending between a mating end and a mounting end configured to be mounted to a circuit board. The receptacle housing includes a plurality of connector cavities open between the mating and mounting ends and side openings along one or more sides of the receptacle housing open to corresponding connector cavities. The receptacle connector assembly includes RF receptacle connectors received in corresponding connector cavities. The RF receptacle connectors are side-loaded into the connector cavities through corresponding side openings in the receptacle housing. The RF receptacle connectors each have an outer contact, a dielectric body received in the outer contact and a center contact received in the dielectric body and surrounded by the outer contact to provide electrical shielding form the center contact. The center contact has a solder tail configured to be soldered to the circuit board. The plug connector assembly has a plug housing having a mating end mated to the mating end of the receptacle housing. The plug housing includes a plurality of connector cavities. The plug connector assembly includes RF plug connectors received in corresponding connector cavities. Each RF plug connector is mated with a corresponding RF receptacle connectors as the plug connector assembly is coupled to the receptacle connector assembly. The RF plug connectors each have an outer contact, a dielectric body received in the outer contact and a center contact received in the dielectric body and surrounded by the outer contact to provide electrical shielding for the center contact. The center contact is terminated to a center conductor of a coaxial cable.

In another embodiment, a receptacle connector assembly is provided for electrical connection with a plug connector assembly having RF plug connectors terminated to ends of coaxial cables. The receptacle connector assembly includes a receptacle housing extending between a mating end configured to be coupled to the plug connector assembly and a mounting end configured to be mounted to a circuit board. The receptacle housing includes a plurality of connector cavities open between the mating and mounting ends. The receptacle housing has side openings along one or more sides of the receptacle housing open to corresponding connector cavities. The receptacle connector assembly includes RF receptacle connectors received in corresponding connector cavities. The RF receptacle connectors are side-loaded into the connector cavities through corresponding side openings in the receptacle housing. The RF receptacle connectors each have a center contact, a dielectric body holding the center contact and an outer contact holding the dielectric body and the center contact. The outer contact and the center contact are configured to be electrically connected to the corresponding RF plug connector. The outer contact provides electrical shielding for the center contact. The center contact has a solder tail configured to be soldered to the circuit board.

In a further embodiment, a plug connector assembly is provided configured to be coupled to a receptacle connector assembly. The plug connector assembly includes a plug housing extending between a mating end configured to be coupled to the receptacle connector assembly and a cable end. The plug housing includes a plurality of connector cavities open between the mating and cable ends. The plug housing has side openings along one or more sides of the plug housing open to corresponding connector cavities. RF plug connectors are received in corresponding connector cavities. The RF plug connectors are side-loaded into the connector cavities through corresponding side openings in the plug housing. The RF plug connectors each have a center contact, a dielectric body holding the center contact and an outer contact holding the dielectric body and the center contact. The outer contact provides electrical shielding for the center contact. The center contact has a terminating end configured to be terminated to a corresponding coaxial cable. The coaxial cable extends from the cable end of the plug housing.

DETAILED DESCRIPTION OF THE INVENTION

Figure 1:
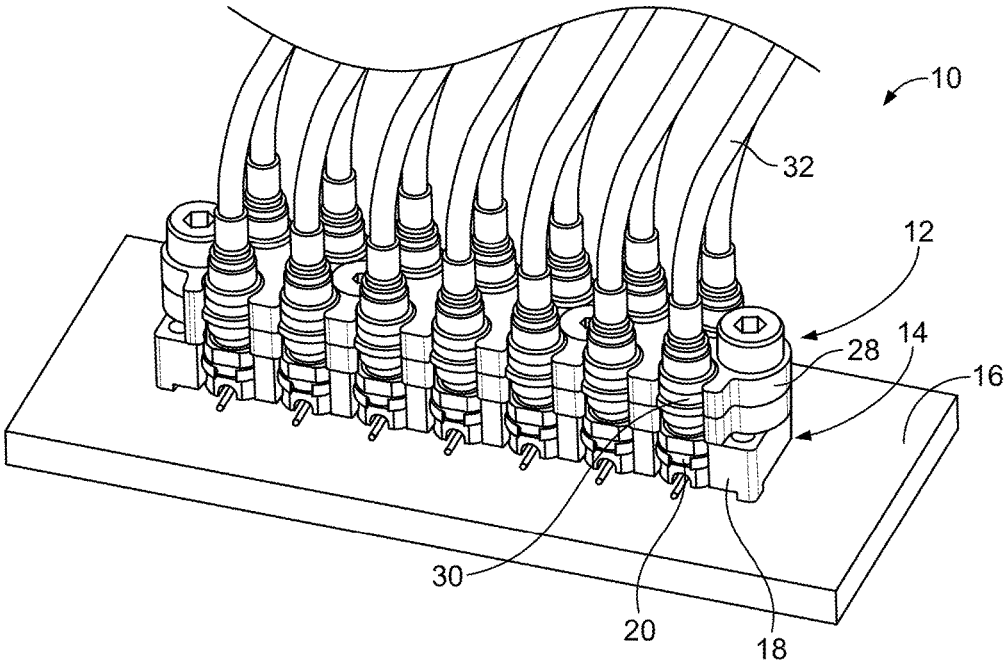
FIG. 1 illustrates an RF connector system including a plug connector assembly and a receptacle connector assembly formed in accordance with an exemplary embodiment.

FIG. 1 illustrates an RF connector system 10 including a plug connector assembly 12 and a receptacle connector assembly 14 formed in accordance with an exemplary embodiment. The plug connector assembly 12 is shown mated to the receptacle connector assembly 14. The connector assemblies 12, 14 include electrical connectors designed to work at radio frequencies, such as in the multi-megahertz range, such as connectors used with coaxial cables that are designed to maintain the shielding that the coaxial cables offer. In an exemplary embodiment, the receptacle connector assembly 14 defines a circuit board assembly that is terminated to a circuit board 16, such as a host board, a motherboard or another type of circuit board. The plug connector assembly 12 defines a cable assembly having connectors thereof terminated to corresponding cables, such as coaxial cables.

The receptacle connector assembly 14 includes a receptacle housing 18 and a plurality of RF receptacle connectors 20 held within the receptacle housing 18. Any number of RF receptacle connectors 20 may be utilized depending on the particular application. In the illustrated embodiment, fourteen RF receptacle connectors 20 are provided in two rows. The RF receptacle connectors 20 are terminated to the circuit board 16. For example, the RF receptacle connectors 20 may be surface mounted to the circuit board 16. The RF receptacle connectors 20 may be soldered to the circuit board 16. In an exemplary embodiment, the RF receptacle connectors 20 are all mounted to the circuit board 16 with the receptacle housing 18 at the same time as a unit and then reflow soldered to corresponding pads on the circuit board 16. In an exemplary embodiment, the solder interface between the RF receptacle connectors 20 and the circuit board 16 are visible for inspection during assembly. In alternative embodiments, the RF receptacle connectors 20 may be terminated to ends of cables rather than being board-mounted.

The receptacle housing 18 holds each of the individual RF receptacle connectors 20 for simultaneous termination to the plug connector assembly 12 (for example, each of the RF receptacle connectors 20 are mated to corresponding plug connectors as the plug connector assembly 12 is mated to the receptacle connector assembly 14).

The plug connector assembly 12 includes a plug housing 28 and a plurality of RF plug connectors 30 held within the housing 28. The RF plug connectors 30 are cable mounted to respective coaxial cables 32. The plug connector assembly 12 and receptacle connector assembly 14 are mated with one another such that the RF receptacle connectors 20 mate with corresponding RF plug connectors 30. The plug housing 28 holds each of the individual RF plug connectors 30 for simultaneous termination to the receptacle connector assembly 14 (for example, each of the RF plug connectors 30 are mated to corresponding RF receptacle connectors 20 as the plug connector assembly 12 is mated to the receptacle connector assembly 14). In alternative embodiments, the plug connector assembly 12 and receptacle connector assembly 14 are both board mounted, or alternatively, both cable mounted.

Figure 2:
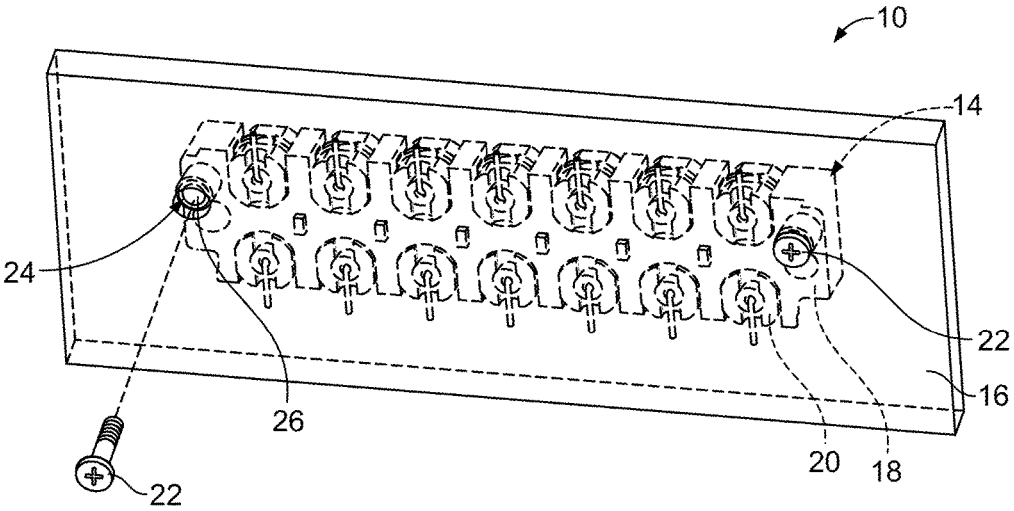
FIG. 2 is a bottom perspective view of a portion of the electrical connector system.

FIG. 2 is a bottom perspective view of a portion of the RF connector system 10 showing the receptacle connector assembly 14 (in phantom) mounted to the circuit board 16. The receptacle connector assembly 14 may be secured to the circuit board 16 using fasteners 22, or other connection means. In an exemplary embodiment, the circuit board 16 includes openings 24 that receive posts 26 extending from the bottom of the receptacle housing 18. The posts 26 are loaded into the openings 24 to position the receptacle connector assembly 14 relative to the circuit board 16, such as for electrically connecting the RF receptacle connectors 20 to the circuit board 16. Optionally, the posts 26 may have internal treaded bores that receive the fasteners 22 to secure the receptacle housing 18 to the circuit board 16. In an exemplary embodiment, after the receptacle connector assembly 14 is mechanically secured to the circuit board 16 using the fasteners 22, the RF receptacle connectors 20 may be soldered to the circuit board 16.

Figure 3:
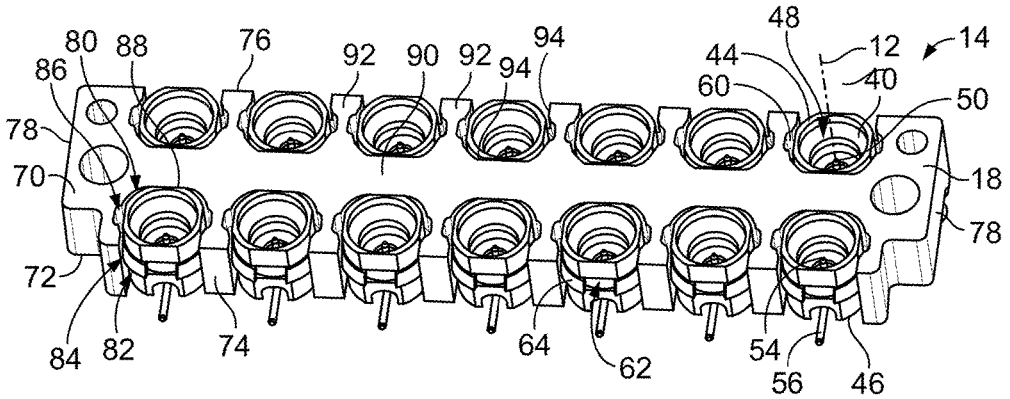
FIG. 3 is a top perspective view of the receptacle connector assembly in accordance with an exemplary embodiment.
Figure 4:
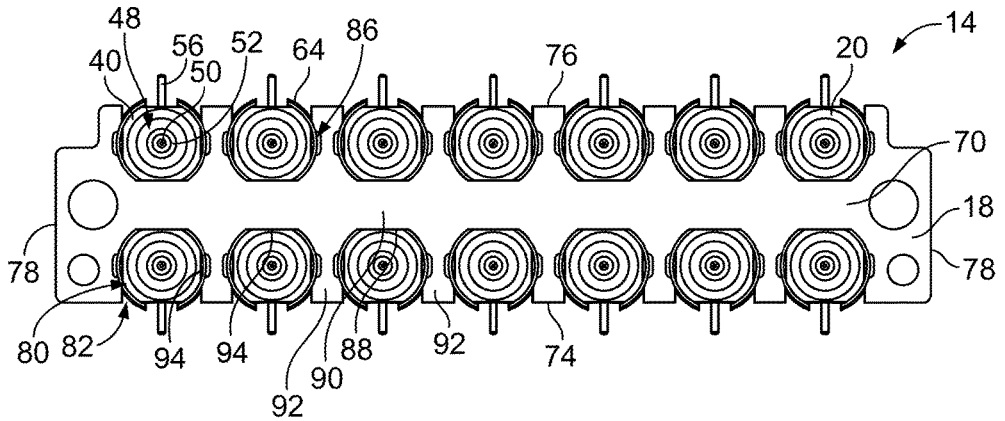
FIG. 4 is a top view of the receptacle connector assembly.
Figure 5:
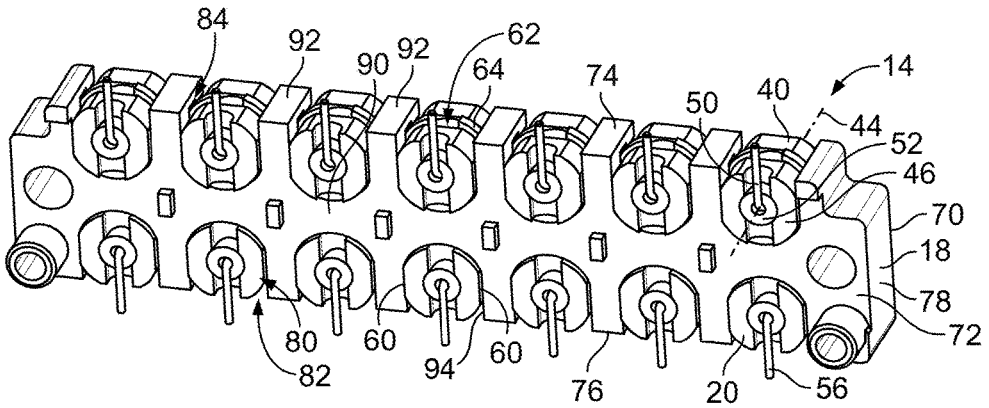
FIG. 5 is a bottom perspective view of the receptacle connector assembly.

FIG. 3 is a top perspective view of the receptacle connector assembly 14 in accordance with an exemplary embodiment. FIG. 4 is a top view of the receptacle connector assembly 14. FIG. 5 is a bottom perspective view of the receptacle connector assembly 14. FIGS. 3-5 show the RF receptacle connectors 20 received in the receptacle housing 18. Each of the RF receptacle connectors 20 are fixed in position relative to each other by the receptacle housing 18 such that each of the RF receptacle connectors 20 are configured to be terminated to the circuit board 16 simultaneously. In an exemplary embodiment, the receptacle housing 18 fixes the RF receptacle connectors 20 relative to each other and may limit or resist rotation of the RF receptacle connectors 20 within the receptacle housing 18. In an exemplary embodiment, the receptacle housing 18 fixes the RF receptacle connectors 20 vertically (for example up and down) and horizontally (for example side to side and/or front to back).

Each RF receptacle connector 20 includes an outer contact 40 extending along a central longitudinal axis 42 between a mating end 44 and a mounting end 46. The outer contact 40 defines a socket 48 configured to receive the corresponding RF plug connector 30 (shown in FIG. 1). The RF receptacle connector 20 includes a center contact 50 held in the outer contact 40 by a dielectric body 52. The center contact 50 has a mating end 54 in the socket 48 for mating with the RF plug connector 30. In the illustrated embodiment, the center contact 50 is a pin contact; however, the center contact 50 may be another type of contact in alternative embodiments, such as a socket contact. The center contact 50, in the illustrated embodiment, has a solder tail 56 opposite the mating end 54 used for electrically connecting the center contact 50 to the circuit board 16. However, in alternative embodiments, the center contact 50 may be terminated to a center conductor of a coaxial cable, such as by crimping, welding, or other means. In the illustrated embodiment, the solder tail 56 is oriented generally perpendicular relative to the mating end 54. For example, the solder tail 56 extends outward from a side of the RF receptacle connector 20 for soldering to the circuit board 16.

In an exemplary embodiment, the outer contact 40 is formed from a conductive material, such as a metal material, and the dielectric body 52 electrically separates the center contact 50 and the outer contact 40. The outer contact 40 circumferentially surrounds the center contact 50 to provide electrically shielding for the center contact 50. In an exemplary embodiment, the mating end 54 is positioned coaxially along the central longitudinal axis 42 of the outer contact 40.

In an exemplary embodiment, the outer contact 40 is generally cylindrical in shape, particularly along the interior profile defining the socket 48. The exterior of the outer contact 50 may include one or more non-uniform or non-cylindrical shaped surfaces used to define locating surfaces 60 configured to engage the receptacle housing 18 to orient the RF receptacle connector 20 in the receptacle housing 18. For example, the locating surfaces 60 may fit against corresponding locating surfaces within the receptacle housing 18 to resist rotation of the RF receptacle connector 20 within the receptacle housing 18 and/or to locate or position the RF receptacle connector 20 within the receptacle housing 18.

In an exemplary embodiment, the outer contact 40 includes a groove 62 in the outer surface of the outer contact 40. The groove 62 receives a retention clip 64, which may be used to secure the RF receptacle connector 20 in the receptacle housing 18. In the illustrated embodiment, the retention clip 64 is a split ring or C-shaped clip configured to be received in the groove 62. The retention clip 64 may be squeezed or compressed to change the shape of the retention clip 64, such as to close the retention clip 64 around the outer contact 40 and release the RF receptacle connector 20 from the receptacle housing 18.

The receptacle housing 18 extends between a mating end 70 and a mounting end 72. The receptacle housing 18 includes a front side 74 and a rear side 76 extending between opposite sides 78 and between the ends 70, 72. The receptacle housing 18 includes a plurality of connector cavities 80 open between the mating and mounting ends 70, 72. The connector cavities 80 receive corresponding RF receptacle connectors 20. In an exemplary embodiment, the receptacle housing 18 has side openings 82 along one or more of the sides of the receptacle housing 18, such as along the front side 74 and along the rear side 76. The side openings 82 are open to the connector cavities 80. In an exemplary embodiment, the RF receptacle connectors 20 are configured to be side loaded into the connector cavities 80 through the corresponding side openings 82. Optionally, the RF receptacle connectors 20 may be removed from and/or replaced through the side openings 82 after the receptacle connector assembly 14 is mounted to the circuit board 16, such as to repair a damaged RF receptacle connector 20 without removing the other RF receptacle connectors 20 from the circuit board 16.

In an exemplary embodiment, the receptacle housing 18 includes retention pockets 84 in the connector cavities 80 that receive corresponding retention clips 64. The retention clips 64 are axially fixed (such as in the vertical direction) along the RF receptacle connectors 20. When the retention clips 64 are received in the retention pockets 84, the RF receptacle connectors 20 are axially fixed within the connector cavity 80. In an exemplary embodiment, the receptacle housing 18 includes release slots 86 open at the mating end 70 configured to receive a releasing tool used to release the retention clip 64. For example, the release slots 86 may be provided on both sides of the connector cavity 80 to allow the retention clips 64 to be squeezed or compressed to allow removal of the RF receptacle connector 20 from the connector cavity 80.

The receptacle housing 18, in the illustrated embodiment, includes caps 88 covering portions of the connector cavities 80. The caps 88 extend over the top of the connector cavities 80 to block the RF receptacle connectors 20. For example, the caps 88 block the RF receptacle connectors 20 from moving vertically upward within the connector cavity 80. The caps 88 are provided at the interior ends of the connector cavity 80; however, the caps 88 may be provided at other locations in alternative embodiments.

In an exemplary embodiment, the receptacle housing 18 includes a spine 90 extending between first and second rows of the connector cavities 80 located at the front side 74 and the rear side 76, respectively. Optionally, the spine 90 may be approximately centered between the front and rear sides 74, 76. The receptacle housing 18 includes transverse ribs 92 extending from both sides of the spine 90. The transverse ribs 92 extend transversely, and may extend perpendicularly, relative to the spine 90. The transverse ribs 92 are located between corresponding connector cavities 80. In an exemplary embodiment, the connector cavities 80 are defined by portions of the transverse ribs 92 and portions of the spine 90. Optionally, each RF receptacle connector 20 engages the spine 90 and two of the transverse ribs 92. The transverse ribs 92 may extend from the spine 90 to the corresponding side 74 or 76. The release slots 86 may be formed in the transverse ribs 92. The retention pockets 84 may be formed in the transverse ribs 92 and/or in the spine 90. The caps 88 may be formed in the spine 90 and/or the transverse ribs 92.

In an exemplary embodiment, at the mounting end 72 (and/or the mating end 70) the transverse ribs 92 include ledges 94 defining portions of the connector cavities 80. The ledges 94 may engage corresponding locating surfaces 60 to orient the RF receptacle connectors 20 in the connector cavities 80. The ledges 94 resist rotation of the RF receptacle connectors 20 in the connector cavities 80.

Figure 6:
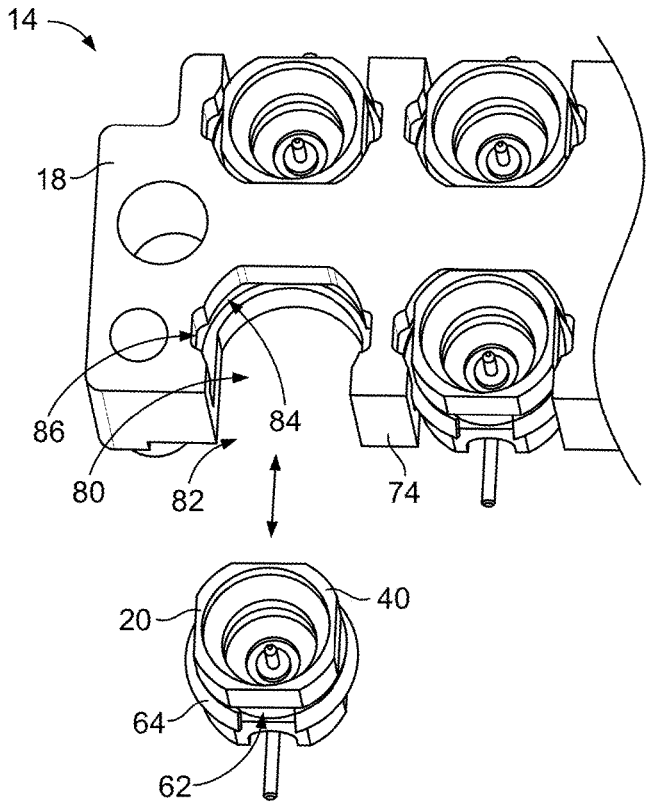
FIG. 6 is a top perspective view of a portion of the receptacle connector assembly.

FIG. 6 is a top perspective view of a portion of the receptacle connector assembly 14 showing one of the RF receptacle connectors 20 removed from the receptacle housing 18 and poised for loading into the receptacle housing 18. The retention clip 64 may be secured to the outer contact 40, such as in the groove 62. The RF receptacle connector 20 may be aligned with the connector cavity 80 at the side opening 82. The RF receptacle connector 20 may be loaded into the connector cavity 80 though the side opening 82. During loading, the retention clip 64 may be compressed to allow the RF receptacle connector 20 to pass through the side opening 82 into the retention pocket 84. After the retention clip 64 clears the side 74, the retention clip 64 may spring outward into the retention pocket 84 to retain the RF receptacle connector 20 in the connector cavity 80. For example, without compressing the retention clip 64, the retention clip 64 retains the RF receptacle connector 20 in the receptacle housing 18. However, after the retention clip 64 is compressed, such as using a release tool in the release slots 86, the RF receptacle connector 20 may be removed from the receptacle housing 18.

Figure 7:
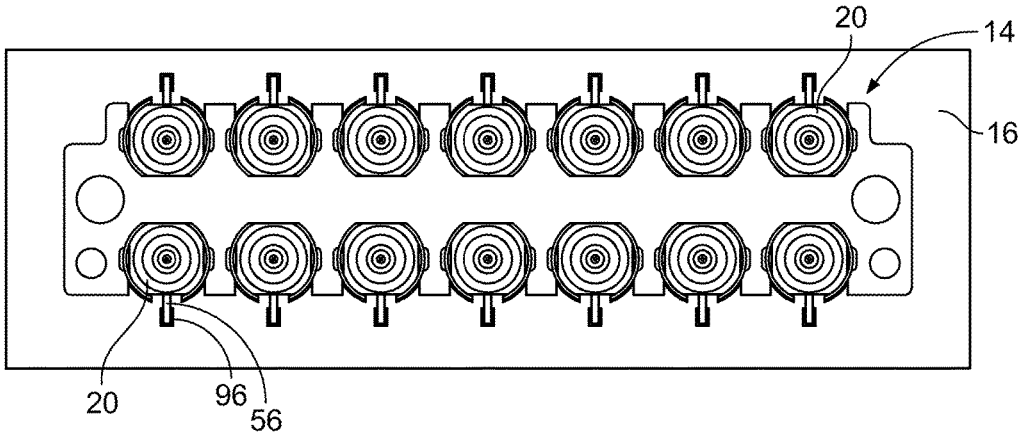
FIG. 7 is a top view of the receptacle connector assembly mounted to a circuit board.

FIG. 7 is a top view of the receptacle connector assembly 14 mounted to the circuit board 16. When the receptacle connector assembly 14 is positioned on the circuit board 16, the solder tails 56 are aligned with corresponding solder pads 96 on the circuit board 16. The solder tails 56 may be simultaneously soldered to the corresponding solder pads 96, such as by reflow soldering the receptacle connector assembly 14 to the circuit board 16. Alternatively, each of the RF receptacle connectors 20 may be individually and sequentially soldered to the corresponding solder pads 96 in other various embodiments.

Figure 8:
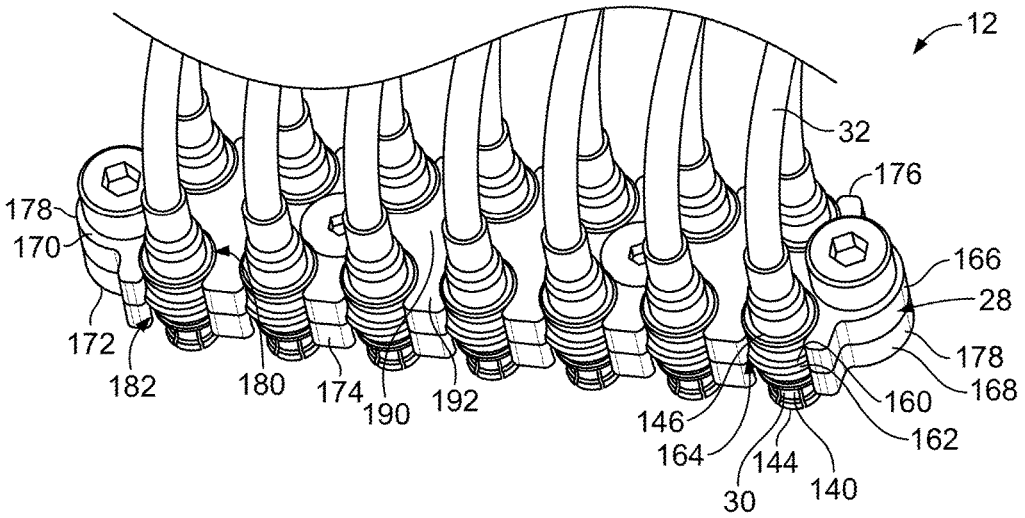
FIG. 8 is a top perspective view of the plug connector assembly in accordance with an exemplary embodiment.
Figure 9:
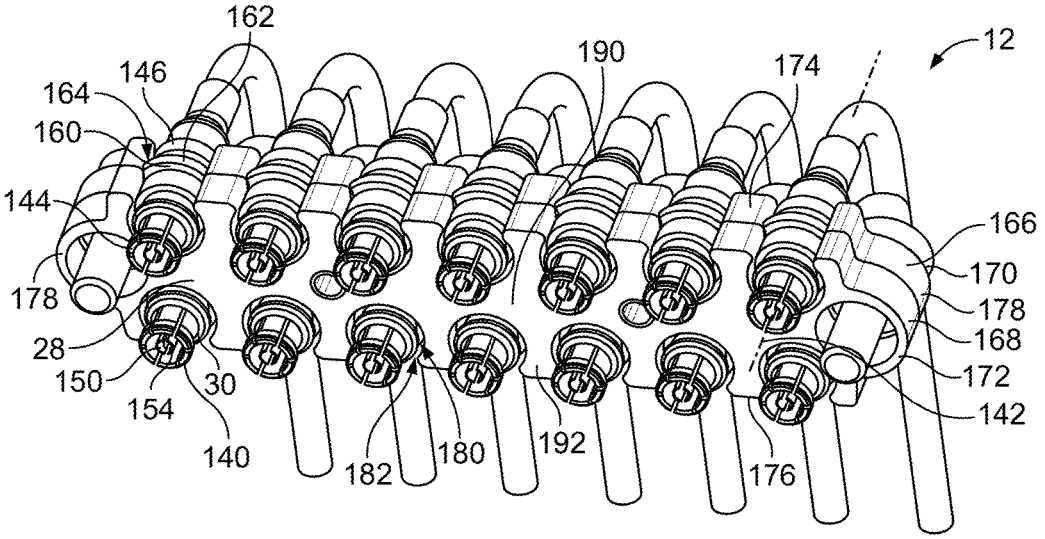
FIG. 9 is a bottom perspective view of the plug connector assembly.

FIG. 8 is a top perspective view of the plug connector assembly 12 in accordance with an exemplary embodiment. FIG. 9 is a bottom perspective view of the plug connector assembly 12. FIGS. 8-9 show the RF plug connectors 30 received in the plug housing 28. Each of the RF plug connectors 30 are fixed in position relative to each other by the plug housing 28 such that each of the RF plug connectors 30 are configured to be terminated to the receptacle connector assembly 14 simultaneously. In an exemplary embodiment, the plug housing 28 fixes the RF plug connectors 30 relative to each other and may limit or resist axial movement of the RF plug connectors 30 within the plug housing 28.

Each RF plug connector 30 includes an outer contact 140 extending along a central longitudinal axis 142 between a mating end 144 and a terminating end 146. The outer contact 140 may be plugged into the socket 48 of the corresponding RF receptacle connector 20 (shown in FIG. 1). The RF plug connector 30 includes a center contact 150 held in the outer contact 140 by a dielectric body 152. The center contact 150 has a mating end 154 for mating with the RF receptacle connector 20. In the illustrated embodiment, the center contact 150 is a socket contact; however, the center contact 150 may be another type of contact in alternative embodiments, such as a pin contact. The center contact 150, in the illustrated embodiment, is configured to be terminated to a center conductor of the cable 32, such as by crimping, soldering, and the like. The outer contact 140 may be terminated to a cable shield of the cable 32, such as by crimping, soldering, and the like.

In an exemplary embodiment, the outer contact 140 is formed from a conductive material, such as a metal material, and the dielectric body 152 electrically separates the center contact 150 and the outer contact 140. The outer contact 140 circumferentially surrounds the center contact 150 to provide electrically shielding for the center contact 150. In an exemplary embodiment, the mating end 154 is positioned coaxially along the central longitudinal axis 142 of the outer contact 140.

In an exemplary embodiment, the outer contact 140 is generally cylindrical in shape. The exterior of the outer contact 150 may include one or more non-uniformed or non-cylindrical shaped surfaces used to define locating surfaces 160 configured to engage the plug housing 28 to orient the RF plug connector 30 in the plug housing 28. For example, the locating surfaces 160 may fit against corresponding locating surfaces within the plug housing 28 to resist rotation of the RF plug connector 30 within the plug housing 28 and/or to locate or position the RF plug connector 30 within the plug housing 28.

In an exemplary embodiment, the outer contact 140 includes a retention flange 162 extending from the outer surface of the outer contact 140. The flange 162 defines the locating surfaces 160. The flange 162 is used to secure the RF plug connector 30 in the plug housing 28. For example, the flange 162 is received in a retention pocket 164 in the plug housing 28. When the retention flanges 162 are received in the retention pockets 164, the RF plug connectors 30 are axially fixed within the connector cavity 180.

In an exemplary embodiment, the plug housing 28 is a multi-piece housing having an upper shell 166 and a lower shell 168. The upper and lower shells 166, 168 are configured to be coupled together, such as around the RF plug connectors 30. For example, the flanges 162 may be captured in the pockets 164 formed between the upper and lower shells 166, 168 generally at the mating interface between the shells 166, 168. In the illustrated embodiment, the pockets 164 are formed in the upper shell 166; however the pockets 164 may additionally or alternatively be formed in the lower shell 168. In alternative embodiments, the plug housing 28 may be a single piece housing rather than a multi-piece housing.

The plug housing 28 extends between a mating end 170 and a mounting end 172. The plug housing 28 includes a front side 174 and a rear side 176 extending between opposite sides 178 and between the ends 170, 172. The plug housing 28 includes a plurality of connector cavities 180 open between the mating and mounting ends 170, 172. The connector cavities 180 receive corresponding RF plug connectors 30. In an exemplary embodiment, the plug housing 28 has side openings 182 along one or more of the sides of the plug housing 28, such as along the front side 174 and along the rear side 176. The side openings 182 are open to the connector cavities 180. In an exemplary embodiment, the RF plug connectors 30 are configured to be side loaded into the connector cavities 180 through the corresponding side openings 182, such as into the side openings 182 in the upper shell 166 and/or into side openings 182 in the lower shell 168. Optionally, the RF plug connectors 30 may be forced into the connector cavities 180 through the side openings 182 and then held therein by the plug housing 28 returning to an uncompressed state.

In an exemplary embodiment, the plug housing 28 includes a spine 190 extending between first and second rows of the connector cavities 180 located at the front side 174 and the rear side 176, respectively. Optionally, the spine 190 may be approximately centered between the front and rear sides 174, 176. The plug housing 28 includes transverse ribs 192 extending from both sides of the spine 190. The transverse ribs 192 extend transversely, and may extend perpendicularly, relative to the spine 190. The transverse ribs 192 are located between corresponding connector cavities 180. In an exemplary embodiment, the connector cavities 180 are defined by portions of the transverse ribs 192 and portions of the spine 190. Optionally, each RF plug connector 30 engages the spine 190 and two of the transverse ribs 192. The transverse ribs 192 may extend from the spine 190 to the corresponding side 174 or 176. The retention pockets 164 may be formed in the transverse ribs 192 and/or in the spine 190.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An RF connector system comprising:

a receptacle connector assembly having a receptacle housing extending between a mating end and a mounting end of the receptacle housing, the mounting end being configured to be mounted to a circuit board, the receptacle housing including a plurality of connector cavities open between the mating and mounting ends, the receptacle housing having side openings along one or more sides of the receptacle housing open to corresponding connector cavities between the mating end and the mounting end of the receptacle housing, the receptacle connector assembly including RF receptacle connectors received in corresponding connector cavities, the RF receptacle connectors being side-loaded into the connector cavities through corresponding side openings in the receptacle housing, the RF receptacle connectors having an outer contact, a dielectric body received in the outer contact and a center contact received in the dielectric body and surrounded by the outer contact to provide electrical shielding for the center contact, the center contact having a solder tail configured to be soldered to the circuit board; and a plug connector assembly coupled to the receptacle connector assembly, the plug connector assembly having a plug housing having a mating end mated to the mating end of the receptacle housing, the plug housing including a plurality of connector cavities, the plug connector assembly including RF plug connectors received in corresponding connector cavities, each of the RF plug connectors being mated with corresponding RF receptacle connectors as the plug connector assembly is coupled to the receptacle connector assembly, the RF plug connectors having an outer contact, a dielectric body received in the outer contact and a center contact received in the dielectric body and surrounded by the outer contact to provide electrical shielding for the center contact, the center contact being terminated to a center conductor of a coaxial cable, the outer contact being terminated to an outer conductor of the coaxial cable.

2. The RF connector system of claim 1, wherein each of the RF receptacle connectors are fixed in position relative to each other and configured to be terminated to the circuit board simultaneously.

3. The RF connector system of claim 1, wherein each of the RF plug connectors are fixed in position relative to each other and configured to be mated to the receptacle connector assembly simultaneously.

4. The RF connector system of claim 1, wherein the solder tails of the center contacts of the RF receptacle connectors are configured to be surface-mounted to the circuit board simultaneously.

5. The RF connector system of claim 1, wherein the receptacle connector assembly further comprises retention clips securing the RF receptacle connectors in the connector cavities.

6. The RF connector system of claim 1, wherein the receptacle housing includes a cap covering a portion of each connector cavity at the mating end, the RF receptacle connectors being captured in the connector cavities below the corresponding caps.

7. The RF connector system of claim 1, wherein the receptacle housing includes a ledge defining a portion of each connector cavity, each RF receptacle connector including a locating surface engaging the ledge of the corresponding connector cavity to orient the RF receptacle connector in the connector cavity and resist rotation of the RF receptacle connector in the connector cavity.

8. The RF connector system of claim 1, wherein the receptacle housing includes a spine between first and second rows of connector cavities, the receptacle housing including transverse ribs extending from both sides of the spine, the transverse ribs being located between and defining portions of the connector cavities, each RF receptacle connector engaging the spine and two of the transverse ribs.

9. The RF connector system of claim 1, wherein the outer contact of each RF receptacle connector extends between a mating end and a mounting end, the outer contact defining a socket receiving the corresponding RF plug connector, the center contact being centered in the socket for mating with the center contact of the corresponding RF plug connector.

10. The RF connector system of claim 1, wherein the plug housing includes side openings along one or more sides of the plug housing open to the corresponding connector cavity, the RF plug connectors being side-loaded into the contact channels through corresponding side openings in the plug housing.

11. The RF connector system of claim 1, wherein the RF plug connectors each include a retention flange, the retention flange being received in a retention pocket in the plug housing to axially secure the RF plug connector in the corresponding connector cavity.

12. The RF connector system of claim 1, wherein the RF plug connectors are freely rotatable within the contact channels and are axially fixed within the contact channels.

13. The RF connector system of claim 1, wherein the plug housing includes an upper shell and a lower shell discrete from the upper shell and secured thereto by a fastener, the RF plug connectors having retention flanges secured between the upper shell and the lower shell at a mating interface between the upper shell and the lower shell.

14. The RF connector system of claim 13, wherein at least one of the upper shell and the lower shell include retention pockets at the mating interface associated with each of the contact channels for receiving corresponding retention flanges of the RF plug connectors.

15. The RF connector system of claim 1, wherein the outer contact of each RF plug connector extends between a mating end and a cable end, the mating end extending below the mating end of the plug housing for plugging into the corresponding RF receptacle connector.

16. The RF connector system of claim 1, wherein the plug housing includes a spine between first and second rows of connector cavities, the plug housing including transverse ribs extending from both sides of the spine, the transverse ribs being located between and defining portions of the connector cavities, each RF plug connector engaging the spine and two of the transverse ribs.

17. The RF connector system of claim 1, wherein the plug connector assembly further comprises a captive screw held in the plug housing, the captive screw having a threaded end configured to be threadably coupled to at least one of the receptacle housing and the circuit board to mate and un-mate the plug connector assembly to and from the receptacle connector assembly.

18. A receptacle connector assembly for electrical connection with a plug connector assembly having RF plug connectors terminated to ends of coaxial cables, the receptacle connector assembly comprising:

a receptacle housing extending between a mating end and a mounting end, the mating end being configured to be coupled to the plug connector assembly, the mounting end being configured to be mounted to a circuit board, the receptacle housing including a plurality of connector cavities open between the mating and mounting ends, the receptacle housing having side openings along one or more sides of the receptacle housing open to corresponding connector cavities between the mating end and the mounting end of the receptacle housing; and RF receptacle connectors received in corresponding connector cavities, the RF receptacle connectors being side-loaded into the connector cavities through corresponding side openings in the receptacle housing, the RF receptacle connectors each having a center contact, a dielectric body holding the center contact and an outer contact holding the dielectric body and the center contact, the outer contact and the center contact being configured to be electrically connected to the corresponding RF plug connector, the outer contact providing electrical shielding for the center contact, the center contact having a solder tail configured to be soldered to the circuit board.

19. A plug connector assembly configured to be coupled to a receptacle connector assembly, the plug connector assembly comprising:

a plug housing extending between a mating end and a cable end, the mating end being configured to be coupled to the receptacle connector assembly, the plug housing including a plurality of connector cavities open between the mating and cable ends, the plug housing having side openings along one or more sides of the plug housing open to corresponding connector cavities between the mating end and the mounting end of the plug housing; and RF plug connectors received in corresponding connector cavities, the RF plug connectors being side-loaded into the connector cavities through corresponding side openings in the plug housing, the RF plug connectors each having a center contact, a dielectric body holding the center contact and an outer contact holding the dielectric body and the center contact, the outer contact providing electrical shielding for the center contact, the center contact having a terminating end configured to be terminated to a corresponding coaxial cable, the coaxial cable extending from the cable end of the plug housing.

20. The plug connector assembly of claim 19, wherein each of the RF plug connectors are fixed in position relative to each other and configured to be mated to the receptacle connector assembly simultaneously.

* * * * *